US011268280B2

(12) United States Patent
Masuya et al.

(10) Patent No.: US 11,268,280 B2
(45) Date of Patent: Mar. 8, 2022

(54) ANCHORAGE OF CONTINUOUS FIBER-REINFORCED POLYMER STRANDS

(71) Applicants: TOKYO ROPE MANUFACTURING CO., LTD., Tokyo (JP); ORIENTAL SHIRAISHI CORPORATION, Tokyo (JP)

(72) Inventors: Hiroshi Masuya, Ishikawa (JP); Yoshihiro Tanaka, Tokyo (JP); Toru Tanaka, Tokyo (JP); Eiji Koda, Tokyo (JP); Hiroshi Watase, Tokyo (JP); Meguru Tsunomoto, Tokyo (JP)

(73) Assignees: TOKYO ROPE MANUFACTURING CO., LTD., Tokyo (JP); ORIENTAL SHIRAISHI CORPORATION, Tokyo (JP)

( * ) Notice: Subject to any disclaimer, the term of this patent is extended or adjusted under 35 U.S.C. 154(b) by 0 days.

(21) Appl. No.: 16/635,223

(22) PCT Filed: Jul. 11, 2018

(86) PCT No.: PCT/JP2018/026214
§ 371 (c)(1),
(2) Date: Jan. 30, 2020

(87) PCT Pub. No.: WO2019/026580
PCT Pub. Date: Feb. 7, 2019

(65) Prior Publication Data

US 2021/0087815 A1 Mar. 25, 2021

(30) Foreign Application Priority Data

Jul. 31, 2017 (JP) ..... JP2017-147677
Jun. 20, 2018 (JP) ..... JP2018-116652

(51) Int. Cl.
*E04C 5/12* (2006.01)
*E04C 5/08* (2006.01)

(52) U.S. Cl.
CPC ..... *E04C 5/125* (2013.01); *E04C 5/085* (2013.01); *E04C 5/127* (2013.01)

(58) Field of Classification Search
CPC ..... E04C 5/085; E04C 5/125; E04C 5/127; E04C 5/073; E04G 21/12
See application file for complete search history.

(56) References Cited

U.S. PATENT DOCUMENTS 1,293,383 A * 2/1919 Eaton ..... F16G 11/12 403/43
2,803,486 A * 8/1957 Larson ..... A01G 23/006 294/82.11

(Continued)

FOREIGN PATENT DOCUMENTS

JP H0953325 A 2/1997
JP H09207117 A * 8/1997

(Continued)

OTHER PUBLICATIONS

JP H1136289 A Machine Translation (Year: 2021).*
JP 2005076388 A Machine Translation (Year: 2021).*

*Primary Examiner* — James M Ference
(74) *Attorney, Agent, or Firm* — Dickinson Wright PLLC

(57) ABSTRACT

In an anchorage (1) of continuous fiber-reinforced polymer (CFRP) strands that anchors continuous fiber-reinforced polymer strands (2) to concrete structures, there is provided an untwisted diameter-expanded portion (3) expanded to a diameter D2 by being radially expanded with respect to a diameter D1 of a general portion (4) of the CFRP strands (2) by untwisting any section of the CFRP strands (2) formed by stranding a plurality of element wires (20, 21) that are bundles of multiple continuous fibers, and filling and curing (Continued)

a time curable material (5) in a clearance among the element wires the untwisted section that is untwisted.

4 Claims, 8 Drawing Sheets

(56) References Cited

U.S. PATENT DOCUMENTS 3,022,713 A * 2/1962 Friberg ..... E04C 5/125 264/34
3,107,983 A * 10/1963 Brandestini ..... E04C 5/125 264/228
3,225,499 A * 12/1965 Kourkene ..... B28B 23/043 52/223.13
3,264,017 A * 8/1966 Lagarde ..... F16G 11/042 403/302
3,507,949 A * 4/1970 Campbell ..... F16G 11/042 264/263
3,551,960 A * 1/1971 Little ..... F16G 11/048 403/268
3,852,930 A * 12/1974 Naaman ..... E04C 5/012 52/664
4,237,942 A * 12/1980 Dietrich ..... E04C 5/125 140/105
4,317,640 A * 3/1982 Peeling ..... F16G 11/042 403/268
4,333,306 A * 6/1982 Yamashita ..... B60C 9/0007 152/451
4,459,722 A * 7/1984 Dziedzic ..... F16G 11/02 24/122.6
4,469,756 A * 9/1984 Jungwirth ..... E04C 5/125 140/105
4,486,991 A * 12/1984 Rahlwes ..... E04C 5/125 24/122.6
4,790,129 A * 12/1988 Hutchins ..... E21D 21/0026 57/204
4,791,237 A * 12/1988 Sherman ..... H01R 4/646 174/40 R
4,798,501 A * 1/1989 Spies ..... E21D 21/0033 405/259.5
5,699,572 A * 12/1997 Castle ..... E21D 11/006 140/123
5,785,463 A * 7/1998 Eaton ..... E21D 20/025 405/302.2
5,919,006 A * 7/1999 Calandra, Jr. ..... E21D 21/02 405/302.2
5,954,455 A * 9/1999 Eaton ..... E21D 20/025 405/259.6
6,270,290 B1 * 8/2001 Stankus ..... E21D 20/025 405/259.1
6,428,243 B1 * 8/2002 Hutchins ..... E21D 20/02 405/259.1
6,984,091 B2 * 1/2006 Maltby ..... E21D 21/008 405/259.1
7,037,046 B2 * 5/2006 Fergusson ..... E21D 21/0033 405/259.5
7,056,463 B2 * 6/2006 Ohta ..... B28B 23/043 156/162
7,451,527 B2 * 11/2008 Pearce ..... F16G 11/05 24/122.6
7,648,311 B2 * 1/2010 Hedrick ..... D07B 5/005 405/259.1
7,896,581 B2 * 3/2011 Fox ..... E21D 21/006 405/259.5
8,327,506 B2 * 12/2012 Klein ..... F16G 11/042 24/122.6
8,550,751 B2 * 10/2013 Fox ..... E21D 21/0033 405/302.2
8,757,934 B2 * 6/2014 Hall ..... E21D 21/006 405/259.1
9,267,376 B2 * 2/2016 Arnot ..... B21F 11/00
2012/0297703 A1 * 11/2012 Sentry ..... E04C 5/122 52/166
2014/0162020 A1 * 6/2014 Wang ..... C03C 25/26 428/113
2016/0122955 A1 * 5/2016 Annan ..... E04C 5/12 52/223.13

FOREIGN PATENT DOCUMENTS

JP H1136289 A 2/1999
JP 2004183325 A 7/2004
JP 2005076388 A 3/2005
JP 2017115485 A 6/2017
KR 20110104342 A * 9/2011

* cited by examiner

ANCHORAGE OF CONTINUOUS FIBER-REINFORCED POLYMER STRANDS

CROSS REFERENCE TO RELATED APPLICATIONS

This U.S. National Stage patent application claims the benefit of PCT International Patent Application Serial No. PCT/JP2018/026214 filed Jul. 11, 2018 entitled "Attachment Fitting For Continuous Fiber Reinforced Stranded Wire" which claims the benefit of JP Patent Application No. 2017-147677 filed Jul. 31, 2017 and JP Patent Application No. 2018-116652 filed Jun. 20, 2018, the entire disclosures of the applications being considered part of the disclosure of this application and hereby incorporated by reference.

TECHNICAL FIELD

The present invention relates to an anchorage of continuous fiber-reinforced polymer strands that anchors the continuous fiber-reinforced polymer (CFRP) strands composed of multiple continuous fibers to concrete structures.

BACKGROUND ART

Conventionally, there has been known, roughly divided, two methods as a technique to anchor a rebar to a reinforced concrete structure or a technique to anchor a tendon to a prestressed concrete structure. A first method is a technique to anchor a rebar to a reinforced concrete structure. This method is that an end portion of the rebar is bent into a U-shape or an L-shape to anchor the rebars to the reinforced concrete structure with its bearing and bonding forces acting on the rebars surface. A second method is a technique to anchor prestressed concrete steel strand or steel PC strands to a concrete structure as prestressing tendons. This method is in combination a bearing plate and a wedge tool using either at a prestressing end portion or at an anchoring end portion of a prestressed concrete structure.

There has been known two methods, similar to a conventional anchoring method, (1) anchoring a continuous fiber-reinforced polymer (CFRP) as a reinforcing material in place of rebars in the reinforced concrete structure, and (2) anchoring a CFRP in place of the steel PC strands as tendons in the prestressed concrete structure. It should be noted that the CFRP here means fiber-reinforced plastics as a composite material that is made by bundling and integrating continuous fibers, such as carbon fibers, aramid fibers, and glass fibers, with a resin, such as an epoxy resin, a vinylester resin, a methacrylate resin, a polycarbonate resin, and a vinyl chloride resin.

However, in the first method, the anchoring of rebars traditionally has been performed by easily bending a straight shaped rebar into a U-shape or an L-shape with a bending machine (bender) when the rebar is used in the reinforced concrete structure. In contrast to this, when a CFRP is used as a reinforcing material in place of the rebar, one problem is that performing a bending process from the straight shaped CFRP requires a significant labor. That is, in order to perform the bending process from the straight shaped CFRP material, there has been a problem that, it is necessary to perform a heating process by fitting the straight shaped CFRP material before the heating process into a hook shaped molding die using dedicated processing equipment in a manufacturing plant. Therefore, additional processing time was required and the processing cost was also extremely expensive.

Meanwhile, in the second method, as described above, when the steel PC strand is used as a tendon, it is common to use a combination of the bearing plate and the wedge tool. In contrast to this, when CFRP material is used as a tendon, the following two anchoring devices have been common; one is the metal sleeve filling adhesive material such as resin material inside which can be expected the bonding resistive forces, and the other is the metal sleeve filling expansive material such as expansive cement grout inside which can be expected the frictional resistive forces. However, in this case, in order to make use of an advantage of CFRP material that is corrosion free, it has been necessary to use an expensive and high performing stainless-steel sleeve, which is considerably excellent in corrosion resistance. In view of this, there has been a problem of cost increase. Moreover, since the element strands composed of CFRP material are low in both shear strength and shear rigidity, there has been a possibility of breakage by clamping forces from a lateral direction caused by, for example, the metal sleeve and expansion pressure. Therefore, there has been a problem that, for example, the production of the anchoring tools using the metal sleeve is limited in some factories because of the stable quality management.

JP-A-2004-183325 discloses a crimping anchoring device that anchors an end portion of steel PC strands to a concrete structure. The crimping anchoring device described in JP-A-2004-183325 achieves crimping by compressing an insert mounted on an outer periphery of the steel PC strands, and it has solid particles arranged between the insert and the steel PC strands to increase friction forces between these two.

However, when CFRP material is used as a tendon instead of the steel PC strands of the crimping anchoring device described in JP-A-2004-183325, there existed the following problem. That is, as described above, since CFRP material is low in both shear strength and shear rigidity, it is highly possible to break the element strands of CFRP by crimping. Therefore, it is impossible to apply the crimping anchoring device described in JP-A-2004-183325 to CFRP tendons.

Furthermore, JP-A-2005-076388 discloses an end anchoring method of a high strength fiber composite cable as an invention relating to anchoring the CFRP material. This end anchoring method of a high strength fiber composite cable described in JP-A-2005-076388 is to achieve anchoring by friction caused by an expansion pressure of an expandable filler 8 by passing a sleeve 2 through a high strength fiber composite cable 1 as a CFRP material and filling the expandable filler 8 inside the sleeve 2.

However, as described above, in order to make use of an advantage of the CFRP material that is corrosion free, it has been necessary to use an expensive and high performing stainless-steel material considerably high in corrosion resistance as a material of the sleeve, and therefore, there has been a problem of causing a cost increase. Moreover, in order to reduce a breakage in association with the shear failure and the shear deformation of the element wires themselves formed of the continuous fibers, it is necessary to increase a diameter and a length of the sleeve, and therefore, there has also been a problem that it is difficult to achieve a downsized anchorage by shortening an anchoring length.

JP-A-2017-115485 discloses a safety barrier wall of a road bridge in a lantern shape anchorage by using a strand shaped CFRP material 3 as a reinforcing material of a precast barrier wall 1, forming an anchor reinforcing portion 3c by unravelling a part of the strand of a portion inserted into a through hole 4a of a precast barrier wall material 4, and bundling a distal end portion of a plurality of element wires obtained by unravelling the strands of the anchor reinforcing portion 3c about a core material using bundles.

This safety barrier wall of the road bridge described in JP-A-2017-115485 unravels the strand of the strand shaped CFRP material 3 into a lantern shape to insert it within the through hole 4a, and then, fills and cures a cement-based filler 5 to make it function as the anchor reinforcing portion 3c. As the reason why the anchoring strength of JP-A-2017-115485 increases, it is described that "at a portion where the strand of the strand shaped CFRP material 3 is unraveled, a clearance is made among a core material 3d and stranded wires 3e and a diameter expands, therefore, a bonding area with the cement-based filler 5 filled into the through hole 4a of the precast barrier wall material 4 increases to increase the anchoring strength of the CFRP material 3." Regarding the cement-based filler, it is described that "as the cement-based filler 5 filled within the through hole 4a, the mortar having high strength, fluidity, and high early strength is used." From these descriptions, it is understood that a peripheral area and an inside of the anchor reinforcing portion 3c in JP-A-2017-115485 is premised to be filled with the cement-based filler high in fluidity without any void. However, a study by the applicants has newly confirmed a problem that an anchoring effect fails to function, in order to anchor the CFRP strands in concrete in which ordinary coarse aggregate is mixed, not in the mortar, because with the method described in JP-A-2017-115485, the concrete is never completely filled within the clearance of the anchor reinforcing portion 3c, and thus, an expected anchoring force cannot be provided.

With the method in JP-A-2017-115485, the clearance at the portion of unraveled strand of the strand shaped CFRP material 3 have an inside that remains hollow with nothing filled in advance. Therefore, when a tensile force corresponding to prestressing force is applied to both ends of the anchor reinforcing portion 3c as described in JP-A-2017-115485, the anchor reinforcing portion 3c disappears, and thus, there lies a problem of failing to obtain a function as an anchorage even though the cement-based filler 5 is filled after being tensioned. That is, the anchorage in JP-A-2017-115485 is limited to a role of rebars anchoring in reinforced concrete structures.

DISCLOSURE OF THE INVENTION

Problems to be Solved by the Invention

Therefore, the present invention has been invented in consideration of the above-described problems and objects of the present invention is to provide an anchorage that: is low cost in manufacturing because the anchorage is manufacturable even at a construction site without using any corrosive metal sleeves; ensures being in a significantly compact shape compared with a conventional anchorage as an anchorage of tension reinforcing material end portion when CFRP strands corresponding to rebars in reinforced concrete is used as tension reinforcing material, and furthermore, as a fixing end portion anchorage that is tensioned after anchoring or a stressed end anchorage that is tensioned before anchoring when the CFRP strands are used as a tendon; and furthermore, ensures anchoring the CFRP strands to concrete structures corresponding widely to a wide variety of purposes without being limited to use cement mortar, cement grout, ordinary concrete material, or the like as cement-based material in surrounding area of anchoring.

Solutions to the Problems

An anchorage of CFRP strands according to claim 1 includes CFRP strands and a single or a plurality of untwisted diameter-expanded portions. The CFRP strands are formed by stranding a plurality of element wires that are bound together multiple continuous fibers. The untwisted diameter-expanded portion is radially expanded with respect to a diameter of a general portion. The untwisted diameter-expanded portion is radially expanded by filling and curing curable materials in a clearance among the element wires in a single or a plurality of untwisted sections where the plurality of element wires in any section of the CFRP strands are untwisted. The general portion is any portion, other than the untwisted section of the CFRP strands.

With an anchorage of CFRP strands, the untwisted diameter-expanded portion has a front and a rear bundled so as not to be untwisted any further in the anchorage of the CFRP strands.

With an anchorage of CFRP strands, the untwisted diameter-expanded portion has a length that is at least five times or more the diameter of the general portion in the anchorage of the CFRP strands.

With an anchorage of CFRP strands, the untwisted diameter-expanded portion has a maximum diameter that is at least 1.2 times or more the diameter of the general portion in the anchorage of the CFRP strands.

Effects of the Invention

According to the invention described in the claims, the untwisted diameter-expanded portion is formed by preliminarily untwisting the element wires, and filling and curing the curable materials in the clearance among the element wires in the untwisted section. Therefore, not only bonding force between the element wires and the concrete increases, but the bearing resistance from the concrete in the peripheral area newly increases due to an increased outside diameter in the untwisted diameter-expanded portion, thereby ensuring the anchoring force enough to resist the tensile force acting on the CFRP strands. With a conventional anchor reinforcing portion in a CFRP material, a material in a peripheral area where anchoring is possible has been limited to mortar or grout high in fluidity considering that the material of an anchoring object is surely filled among the element wires. That is, only the material in the peripheral area where anchoring is made is not limited to the mortar or the grout, and it is possible to provide a stable anchoring performance to an ordinary concrete material in which the coarse aggregate is mixed.

According to the invention described in the claims, the untwisted diameter-expanded portion is formed by preliminarily untwisting the element wires, and filling and curing the curable materials in the clearance among the element wires in the untwisted section. Therefore, when the CFRP strands are used as a tendon, an application method to anchor in the concrete as a fixing end portion anchorage and being prestressed, and an application method that provides the untwisted diameter-expanded portion in the middle of the CFRP strands and causes the untwisted diameter-expanded portion to function as a stressed end anchorage after prestressing.

According to the invention described in the claims, the untwisted diameter-expanded portion is formed by preliminarily untwisting the element wires, and filling and curing the curable materials in the clearance among the element wires in the untwisted section. Therefore, the anchorage according to the invention described in the claims is applicable as the fixing end portion anchorage or as the stressing end anchorage in a post-tension method. Furthermore, in both of these usages, the anchorage is anchored inside the concrete structure, and therefore, rust prevention measures and counterterrorism measures are not necessary due to no contact between the anchorage and an outside. Meanwhile, with a conventional anchoring end portion of steel PC strands and CFRP strands, an anchoring device is projected outward of the anchoring end portion in a case of a combination of an anchor plate and wedge anchoring or a case of the anchor plate and an expansion material sleeve anchoring. Therefore, the rust prevention measures, such as an oil seal inside the anchoring device, are necessary, and for the counterterrorism measures, there is no specific measures at present.

According to the invention described in the claims, it is not necessary to have a member corresponding to the metal sleeve or perform a heating process by fitting the CFRP strands in a mold to bend the CFRP strands in a plant or the like as with a conventional anchorage. Therefore, the anchorage can be manufactured even at a construction site, thereby ensuring a reduced manufacturing cost. Moreover, since it is not necessary to have the member corresponding to the metal sleeve, the CFRP strands can be transported in a rolled shape, thereby increasing transport efficiency, thus ensuring a lowered transportation cost.

Moreover, according to the invention described in the claims, since the untwisted diameter-expanded portion can be formed in any sections of the CFRP strands, an anchoring position is not limited to the end portion of the CFRP strands, thereby improving a freedom of design.

In particular, according to the invention described in claim 2, since the untwisted diameter-expanded portion has the front and the rear bundled so as not to be untwisted any further, a shape management of the untwisted diameter-expanded portion can be accurately performed, and a filling operation of the curable materials is smoothly performed to ensure improving the operation efficiency.

In particular, according to the invention described in claim 3, since the untwisted diameter-expanded portion has the length that is at least five times or more the diameter of the general portion, an anchoring length can be shortened, thereby ensuring achieving a downsized anchorage of the CFRP strands.

In particular, according to the invention described in claim 4, since the untwisted diameter-expanded portion has the maximum diameter that is at least 1.2 times or more the diameter of the general portion, the anchoring force is improved, thereby ensuring surely providing a function as an anchoring anchorage.

DESCRIPTION OF PREFERRED EMBODIMENTS

The following describes an exemplary anchorage of CFRP strands according to the present invention and the manufacturing method in details with reference to drawings.

Anchorage of CFRP Strands

First Configuration

First, using from FIG. 1 to FIG. 6, an anchorage of CFRP strands according to a first configuration of the present invention will be described.

Figure 1:
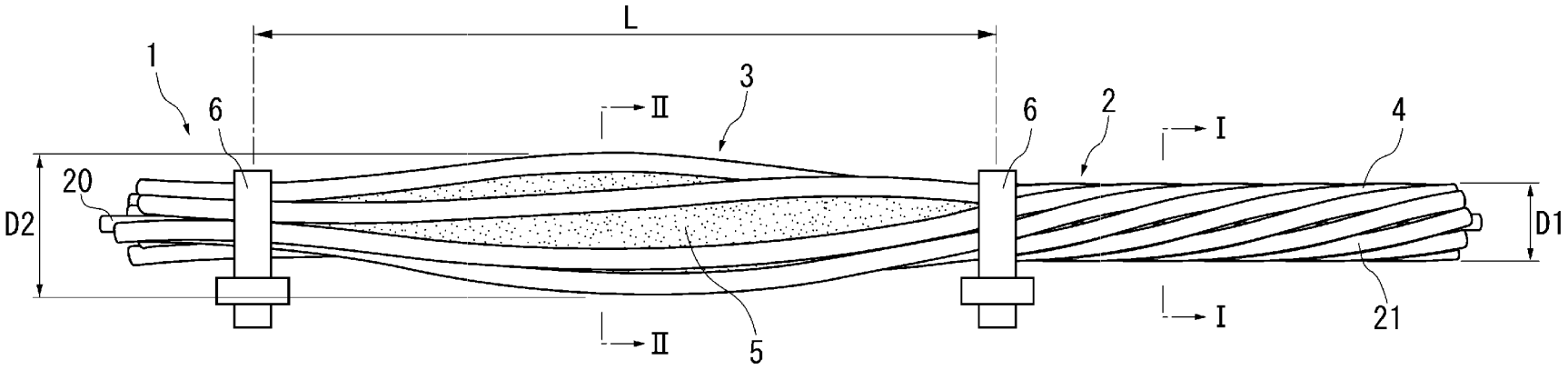
FIG. 1 is a side view, viewed in a direction perpendicular to an axial direction of CFRP strands, illustrating a configuration of an anchorage of CFRP strands.
Figure 2:
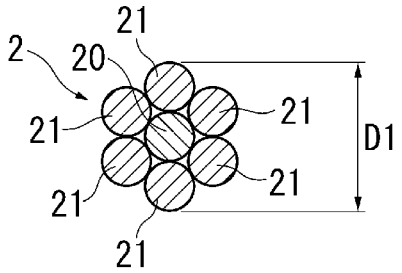
FIG. 2 is a cross-sectional view taken along I-I in FIG. 1.
Figure 3:
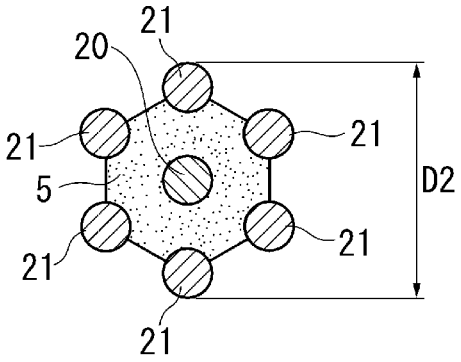
FIG. 3 is a cross-sectional view taken along II-II in FIG. 1.

FIG. 1 is a side view, viewed in a direction perpendicular to an axial direction of CFRP strands, illustrating a first configuration of an anchorage of CFRP strands. FIG. 2 is a cross-sectional view taken along I-I in FIG. 1, and FIG. 3 is a cross-sectional view taken along II-II in FIG. 1.

As illustrated in from FIG. 1 to FIG. 3, an anchorage 1 of CFRP strands (hereinafter simply referred to as the anchorage 1) according to the first configuration is an untwisted type anchorage mainly configured of CFRP strands 2, an untwisted diameter-expanded portion 3 formed in any section of the CFRP strands 2, and the like.

CFRP Strands

The CFRP strands 2 are structural cable formed of CFRP strands formed by stranding a plurality (seven in illustrated configuration) of element wires (20, 21) formed of approximately circular cross-sectional shapes with a diameter of bundles of multiple continuous fibers of approximately 5 mm. The element wire according to the embodiment is, what is called, a Carbon Fiber-Reinforced Plastics (CFRP) element wire, which is made by binding and bundling a multiple (approximately tens of thousands of) carbon fibers having a diameter of approximately 5 μm to 7 μm applying thermosetting resin. That is, the CFRP strands 2 used in the present invention are premised that it is in a rope shape with the stranded element wires, and has a structure that can be untwisted.

Surely, the continuous fiber according to the present invention is not limited to the carbon fiber, but it may be an aramid fiber or a glass fiber. Basically, the continuous fiber is only necessary to be a long continuous fiber having predetermined tensile strength. However, using the carbon fiber provides tensile strength of approximately 2690 $N/mm^2$, thereby ensuring a reinforcing material or a tendon having extremely high strength compared with a steel PC strands.

The thermosetting resin is preferably an epoxy resin or a vinylester resin highly resistant to alkalinity of a cement-based filler. It should be noted that the element wire can be bound and bundled with a thermoplastic resin instead of the thermosetting resin. This thermoplastic resin includes a polycarbonate resin, a vinyl chloride resin, and the like.

The CFRP strand 2 according to the first configuration is formed of seven element wires in total of one core wire 20 positioned in a center in an axial direction and six side wires 21 stranded about the core wire 20 as illustrated in FIG. 2. In view of this, the CFRP strand 2 is a structurally balanced cable with no rigidity difference in a bending direction of the stranded wire. It should be noted that the CFRP strands 2 according to the configuration have a diameter (D1) of approximately 7.5 mm to 19.3 mm.

Figure 4:
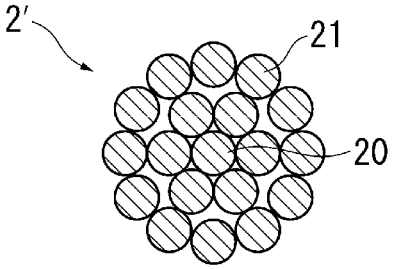
FIG. 4 is a cross-sectional view perpendicular to an axial direction of CFRP strands.

However, the CFRP strands according to the present invention may be CFRP strands 2' according to a modification 1, formed of 19 element wires in total of one core wire 20 positioned in the center in the axial direction and 18 side wires 21 stranded about the core wire 20 as illustrated in FIG. 4.

FIG. 4 is a cross-sectional view perpendicular to the axial direction of the CFRP strands according to the modification 1.

Figure 5:
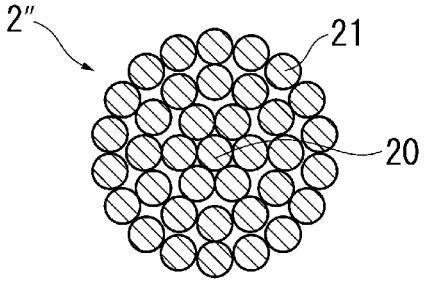
FIG. 5 is a cross-sectional view perpendicular to an axial direction of CFRP strands.

As illustrated in FIG. 5, the CFRP strands according to the present invention may be CFRP strands 2" according to a modification 2 formed of 37 element wires in total of one core wire 20 positioned in the center in the axial direction and 36 side wires 21 stranded about the core wire 20.

FIG. 5 is a cross-sectional view perpendicular to the axial direction of the CFRP strands according to the modification 2.

At this time, the CFRP strands 2' according to the modification 1 have a diameter (D1) of approximately 20.5 mm to 28.5 mm, and the CFRP strands 2" according to the modification 2 have a diameter (D1) of approximately 35.5 mm to 40.0 mm. Basically, the CFRP strands according to the present invention preferably have a diameter (D1) range within a range of approximately 7.5 mm to 40.0 mm.

Untwisted Diameter-Expanded Portion

The untwisted diameter-expanded portion 3 is formed by filling and curing curable materials 5 in a clearance formed by untwisting the side lines 21 into a gradual lantern shape over a length L of any section of the above-described CFRP strands 2 as illustrated in FIG. 1 and FIG. 3. This untwisted diameter-expanded portion 3 is a portion with a diameter expanded (outer diameter expanded) larger than the diameter D1 of a general portion 4 of the CFRP strands 2. It should be noted that a method for forming the untwisted diameter-expanded portion 3 is described in details in a method for manufacturing the anchorage 1 of CFRP strands described below.

Here, untwisting means increasing intervals among the side lines 21 by unraveling the strand of the side lines 21 excluding the core wire 20 in the above-described CFRP strands 2. The general portion 4 is a portion excluding an untwisted section of the length L (untwisted section). The diameter D1 of the general portion 4 means an outer diameter of the above-described CFRP strands 2 itself.

The curable materials 5 used in the anchorage 1 according to the embodiment are preferred to be, for example, the resin mortar made from an epoxy resin, fine aggregate, and the like, the polymer cement mortar made from quick setting cement, a synthetic resin, fine aggregate, water, and the like, and the grout cement mortar made from quick setting cement, a non-shrink material, silica sand, water, and the like. Surely, it is needless to mention that the curable materials according to the present invention are applicable without limiting a kind of material as long as the material has fluidity to some extent when it is filled and cures after a predetermined time. However, the strength of the curable materials is preferred to be equal to or more than the compressive strength (design compressive strength) of concrete in a peripheral area where the anchorage 1 is anchored, and preferably, is higher by approximately 2 to 5 N/mm$^2$. The reason why the compressive strength of the curable materials is made larger than the compressive strength of the concrete in the peripheral area where the anchorage 1 is anchored, is to ensure surely receiving bearing resistance from the concrete in the peripheral area by having a core effect in the compressive strength in the untwisted diameter-expanded portion. For the curable material 5 according to the first configuration, one that has strength after curing of approximately 30 to 80 N/mm$^2$ is used.

The length L of the untwisted section as illustrated in FIG. 1, that is, the length L of the untwisted diameter-expanded portion 3 varies depending on a purpose of the anchorage. That is, when the CFRP strands are applied as a substitute of conventional tensile rebars, it is not necessary to guarantee an anchoring performance of the anchorage of the CFRP strands up to a guaranteed breaking load of the CFRP strands, but is sufficient with approximately 60% of it. In such a case, the length L of the untwisted diameter-expanded portion 3 is preferably within a range of 5 to 20 times the diameter D1 of the general portion 4. Meanwhile, when the CFRP strands are used as a tendon, it is necessary to guarantee the anchoring performance of the anchorage of the CFRP strands up to the guaranteed breaking load of the CFRP strands. In such a case, the length L of the untwisted diameter-expanded portion 3 is preferably within a range of 7 to 20 times the diameter D1 of the general portion 4. Thus, compared with a conventional anchorage, an anchoring length can be shortened, thereby ensuring achieving a downsized anchorage of the CFRP strands.

The maximum diameter D2 of the untwisted diameter-expanded portion 3 illustrated in FIG. 3 is preferably 1.2 to 2.6 times the diameter D1 of the general portion 4 when the CFRP strands are used as the substitute of the above-described tensile rebars. Meanwhile, also when the CFRP strands are used as the substitute of the above-described tendon, it is preferably also 1.2 to 2.6 times the diameter D1 of the general portion 4. Thus, compared with a conventional anchorage, a lateral width of the anchorage can be decreased, thereby ensuring achieving a downsized anchorage of the CFRP strands.

It should be noted that the untwisted diameter-expanded portion 3 has a front and a rear bundled with cable ties 6, such as INSULOKs (registered trademark), such that the CFRP strands 2 are not untwisted any further and the strand of the side lines 21 is not unraveled. In view of this, a shape management of the anchorage of the CFRP strands can be accurately performed, thereby ensuring a productization as a highly reliable anchorage.

Surely, the cable tie 6 can bundle even if it is a different binder, such as a binding wire (annealed thin iron wire). However, for rust prevention, the cable tie 6 is preferably a binder made of a resin material, such as the INSULOK (registered trademark).

Anchoring Mechanism of Anchorage

Figure 6:
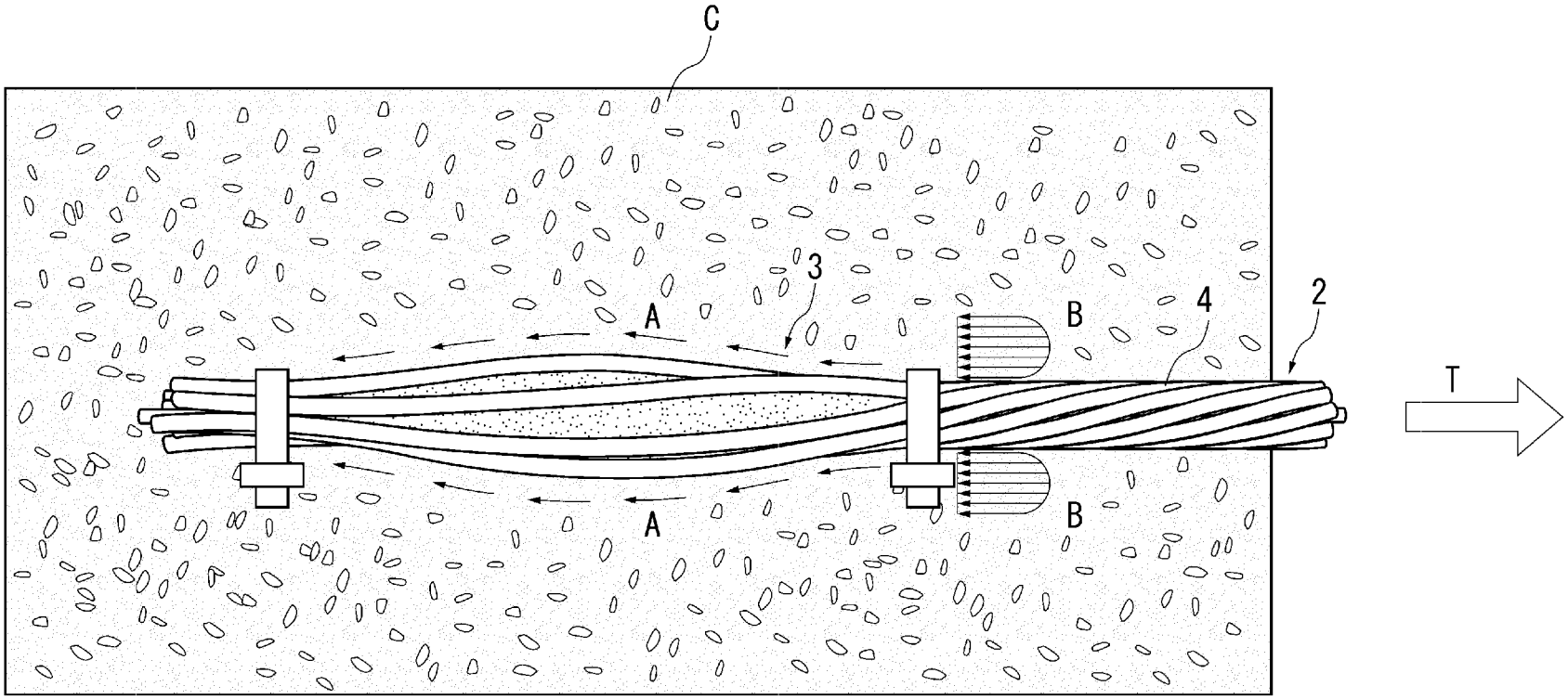
FIG. 6 is an explanatory diagram that describes an anchoring mechanism of an anchorage of CFRP strands.

Next, using FIG. 2, FIG. 3, and FIG. 6, an anchoring mechanism of the above-described anchorage 1 will be described. FIG. 6 is an explanatory diagram that describes the anchoring mechanism of the anchorage 1.

The anchoring mechanism of the anchorage 1 according to the first configuration is mainly configured of two factors. An anchoring mechanism 1 as the first factor is a point that the maximum diameter D2 of the untwisted diameter-expanded portion 3 of the anchorage 1 is larger by at least 1.2 times or more the diameter D1 of the general portion 4 by unraveling the strand of the side lines 21, and filling and curing the curable materials 5 as described above. This causes the anchorage 1 to receive tensile force from a concrete C in the peripheral area or bearing resistance B resisting tensioning force T as illustrated in FIG. 6, therefore, it is a mechanism to increase anchoring efficiency of the anchorage 1. The reason why the bearing resistance B can be generated is because the curable materials 5 are not deformed or compressed to be broken since the compressive strength of the curable materials 5 in the untwisted diameter-expanded portion 3 is equal to or more than the compressive strength of the concrete C in the peripheral area.

In the anchoring mechanism 2 as the second factor, a bonding force A is increased due to an increased surface area in contact with the concrete C in the untwisted diameter-expanded portion 3 caused by unraveling the strand of the side lines 21, and filling and curing the curable materials 5. In the anchoring mechanism 2, furthermore, a mechanical bonding force A with the concrete C is increased by a significant unevenness formed by the outer surface of the curable materials 5 and the side lines 21 since the intervals among the side lines 21 of the untwisted diameter-expanded portion 3 illustrated in FIG. 3 is wider than the intervals among the side lines 21 of the general portion 4 illustrated in FIG. 2. The anchoring mechanism 2 ensures the increased anchoring efficiency of the anchorage 1 as a result of these two effects.

other than the untwisted diameter-expanded portion 3, the bond stress was cut with a vinyl tape+application of grease. Grout cement mortar with compressive strength of 70 N/mm$^2$ was used as the curable materials 5 into the untwisted diameter-expanded portion 3.

For CFRP strands of the test pieces, there were fabricated twelve types of test pieces in total of eleven types of test pieces of the anchors 1 having the lengths L of the untwisted diameter-expanded portions 3 of 5.0 to 11.8 times the diameter D1 of the general portion 4, and a reference test piece that is without an untwisting process for a comparison of anchoring efficiencies and have an anchoring length of 11.8 times the diameter D1.

In the pull-out experiment 1, the maximum pull-out loads Pm (kN) of the respective test pieces were measured and ratios (load ratio Pm/Pg) to the guaranteed breaking load Pg (kN) were obtained. The one core wires 20 in the centers of the CFRP strands 2 were projected approximately 5 mm from distal ends of the anchors 1 to be projected from end surfaces of the concrete test pieces. With this, extraction displacement in conjunction with the pull-out loads of the anchors 1 was measured. The results are shown in Table 1 below.

TABLE 1

Pull-out experiment 1
Diameter D1 of general portion = 15.2 mm, Guaranteed breaking load Pg = 270 kN
Concrete compressive strength = 56 N/mm$^2$, Curable material compressive strength = 70 N/mm$^2$

| Test piece | Diameter-expanded portion D2 (mm) | D2/D1 | Length-expanded portion L (mm) | L/D1 | Maximum pull-out load Pm (kN) | Load ratio Pm/Pg | Extraction displacement δ during Pm (mm) | Ratio to extraction of non-untwisted | Apparent bonding stress (N/mm$^2$) |
|---|---|---|---|---|---|---|---|---|---|
| Non-untwisted | 15.2 | 1.0 | 180.0 | 11.8 | 118.0 | 0.44 | 20.1 | 1.00 | 13.7 |
| Untwisted 1 | 23.7 | 1.6 | 167.2 | 11.0 | 255.1 | 0.94 | 13.4 | 0.67 | 32.0 |
| Untwisted 2 | 22.5 | 1.5 | 152.0 | 10.0 | 270.3 | 1.00 | 14.4 | 0.72 | 37.3 |
| Untwisted 3 | 22.5 | 1.5 | 136.8 | 9.0 | 224.1 | 0.83 | 17.5 | 0.87 | 34.3 |
| Untwisted 4 | 21.9 | 1.4 | 121.6 | 8.0 | 183.5 | 0.68 | 15.3 | 0.76 | 31.6 |
| Untwisted 5 | 20.4 | 1.3 | 106.4 | 7.0 | 118.4 | 0.44 | 13.6 | 0.68 | 23.3 |
| Untwisted 6 | 18.5 | 1.2 | 91.2 | 6.0 | 87.7 | 0.32 | 18.7 | 0.93 | 20.1 |
| Untwisted 7 | 18.2 | 1.2 | 76.0 | 5.0 | 53.6 | 0.20 | 12.2 | 0.61 | 14.8 |
| Untwisted 8 | 24.7 | 1.6 | 127.5 | 8.4 | 243.8 | 0.90 | 12.1 | 0.60 | 40.1 |
| Untwisted 9 | 29.3 | 1.9 | 145.0 | 9.5 | 260.4 | 0.96 | 9.0 | 0.45 | 37.6 |
| Untwisted 10 | 34.2 | 2.3 | 162.5 | 10.7 | 272.2 | 1.01 | 3.6 | 0.18 | 35.1 |
| Untwisted 11 | 39.7 | 2.6 | 180.0 | 11.8 | 270.4 | 1.00 | 2.3 | 0.11 | 31.5 |

Verification Experiments

Next, using Table 1, Table 2, and FIG. 7, verification experiments that have been performed to confirm an anchoring effect of the present invention will be described.

Pull-Out Experiment 1

First, a pull-out experiment 1 in which CFRP strands are pulled out from test pieces in which the CFRP strands composed of the carbon fibers similar to the above-described anchorage 1 are anchored in concrete was executed. In this pull-out experiment 1, CFRP strands (guaranteed breaking load Pg=270 kN) with the diameter D1=15.2 mm formed of seven element wires similar to the above-described anchorage 1 was used. The maximum diameters D2 of the untwisted diameter-expanded portions 3 were 1.2 to 2.6 times the diameter D1 of the general portions 4. The test pieces have a concrete portion whose cross-sectional dimension was 500 mm×500 mm and whose length was 470 mm. Relatively high strength concrete with compressive strength of 56 N/mm$^2$ was used. For a portion of the CFRP strands As illustrated in Table 1, the pull-out experiment 1 has summarized experimental results such that the non-untwisted reference test piece (anchoring length L=180.0 mm) (non-untwisted) and untwisted test pieces (untwisted 1 to untwisted 11) with various kinds of varied shape parameters can be compared. Regarding extracted displacement during maximum pull-out loads are applied (during Pm), from results indicating the ratio based on the reference test piece, it is seen that every test piece of the anchors 1 has small extracted displacement and provides a satisfactory performance as an anchorage. As a result of obtaining apparent bonding stresses during the maximum pull-out loads are applied (during Pm) from bonding areas presuming that the diameters of the diameter-expanded portions are the diameter D1 of the general portion, and also as a result of comparing the apparent bonding stresses with that of the non-untwisted reference test piece, it was found that every test piece of the anchors 1 had the apparent bonding stress larger than that of the non-untwisted reference test piece.

From these results, it is found that the length L of the untwisted diameter-expanded portion 3 can provide its anchoring effect as long as it is at least five times or more the diameter D1 of the general portion 4. It is also found that the maximum diameter D2 of the untwisted diameter-expanded portion 3 can provide its anchoring effect as long as it is at least 1.2 times or more the diameter D1 of the general portion 4.

Pull-Out Experiment 2

In a pull-out experiment 2, the comparisons of pull-out experiments were performed for a case where the curable material 5 (polymer cement mortar, compressive strength=74 N/mm$^2$) filled into the untwisted diameter-expanded portion 3 was filled and a case where the curable material 5 was not filled, and the influences on the anchoring effect of the curable materials 5 were examined. The used CFRP strands have a diameter D1=15.2 mm (guaranteed breaking load Pg=270 kN). The concrete test piece has a cross-sectional dimension of 150 mm×150 mm, is provided with a 20 mm bonding cut, and has concrete compressive strength of 71 N/mm$^2$.

The maximum diameter D2 of the untwisted diameter-expanded portion 3 was 1.5 times the diameter D1 of the general portion 4. For CFRP strands of test pieces, three types of test pieces with lengths L of the untwisted diameter-expanded portions 3 of ten times (L=152 mm), fifteen times (L=228 mm), and twenty times (L=304 mm) the diameter D1 of the general portion 4 were fabricated. The results of the pull-out experiment 2 are shown in Table 2 below.

TABLE 2

Pull-out experiment 2
Diameter D1 of general portion = 15.2 mm,
Guaranteed breaking load Pg = 270 kN, D2/D1 = 1.5
Concrete compressive strength = 71 N/mm$^2$,
Curable material compressive strength = 74 N/mm$^2$

| Presence/absence of curable material | Length L of untwisted diameter-expanded portion (mm) | L/D1 ratio | Maximum pull-out load Pm (kN) | Load ratio Pm/Pg |
|---|---|---|---|---|
| Curable material | 152 | 10 | 165 | 0.61 |
| polymer cement | 228 | 15 | 247 | 0.92 |
| mortar | 304 | 20 | 270 | 1.00 |
| No curable | 152 | 10 | 38 | 0.14 |
| material | 228 | 15 | 128 | 0.47 |
| | 304 | 20 | 198 | 0.74 |

From the results of the pull-out experiment 2, the results of the case where the curable materials were filled in the untwisted diameter-expanded portion 3 and the pull-out experiment was performed after predetermined strength had developed, demonstrated approximately similar tendency of the pull-out experiment 1. Meanwhile, the case where the curable materials were not filled in the untwisted diameter-expanded portion resulted in a substantially reduced pull-out load. This is because, even when the concrete was placed in the peripheral area of the CFRP strands having the void untwisted diameter-expanded portion 3, the maximum aggregate diameter of the concrete was 20 mm, and therefore, the concrete was never sufficiently filled inside the untwisted diameter-expanded portion, thereby resulting internally leaving a void. As a result, it is determined that an original role of the untwisted diameter-expanded portion 3 could no longer be played. That is, it is found that the curable materials being filled and cured in the clearance among the element wires of the CFRP strands in the untwisted section is indispensable.

Pull-Out Experiment 3

Next, a pull-out experiment 3 will be described. The pull-out experiment 3 is comparisons of relationships between the pull-out loads and extraction displacements for the non-untwisted reference test piece, and the test pieces of the untwisted 10 and the untwisted 11 executed in the pull-out experiment 1.

In the pull-out experiment 3, for the reference test piece that was non-untwisted and had a length of an anchoring portion of 180 mm, the untwisted 10 had D2/D1=2.3, L/D1=10.7, and the untwisted 11 had D2/D1=2.6, L/D1=11.8.

Figure 7:
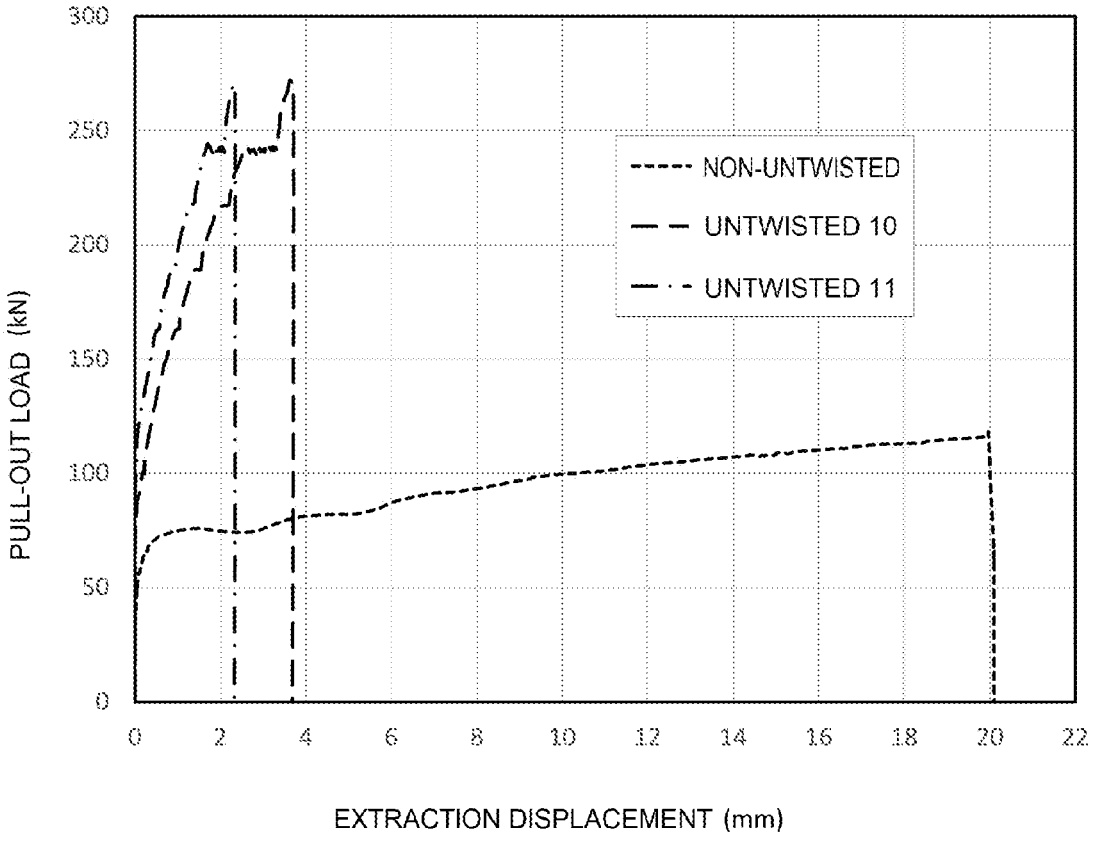
FIG. 7 is a graph that represents relationships between pull-out loads and extraction displacements in a pull-out experiment of the anchorage of the CFRP strands.

FIG. 7 is a graph that represents the relationships between the pull-out loads and the extraction displacements. The extraction displacements of the non-untwisted reference test piece start occurring near a pull-out load of 50 kN. Meanwhile, in the cases of the test pieces of the untwisted 10 and the untwisted 11, the extraction displacements do not occur until near a pull-out load of 100 kN. The non-untwisted reference test piece is pulled out approximately 20 mm until reaching the maximum pull-out load, but the untwisted test pieces are pulled out approximately 2 mm to 4 mm, and they are considerably small. From the comparisons described above, it is found that the anchorage 1 of the untwisted diameter-expanded portion 3 having the curable materials 5 has an excellent anchoring performance.

Method for Manufacturing Anchorage of CFRP Strands

Next, using FIG. 8, a method for manufacturing the anchorage of the CFRP strands according to the embodiment of the present invention will be described. The description will be given with an example where the above-described anchorage 1 is manufactured.

(1) Untwisting Process

Figure 8:
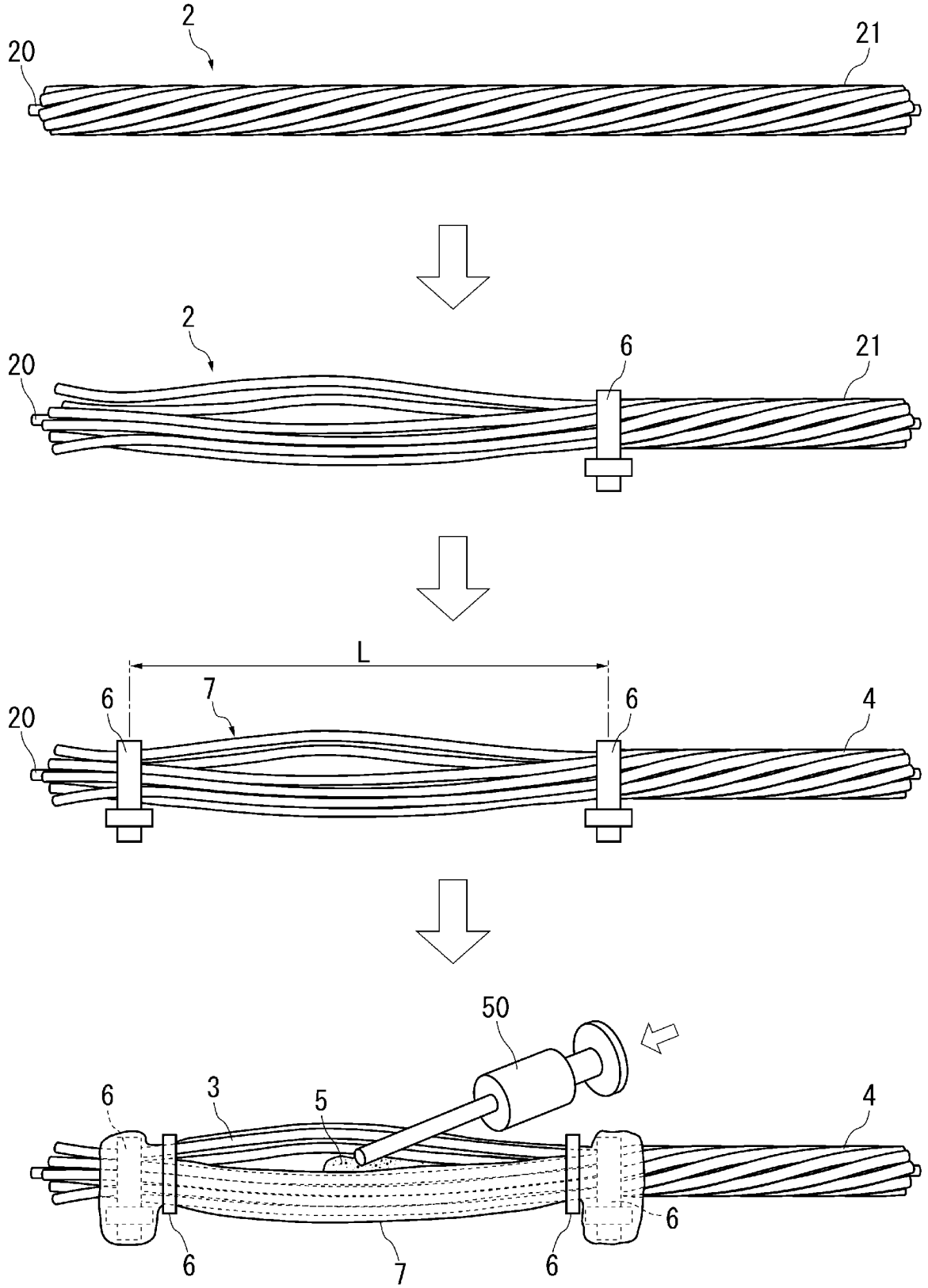
FIG. 8 is a process explanatory diagram that illustrates each process of a method for manufacturing the anchorage of the CFRP strands.

First, in the method for manufacturing the anchorage according to the embodiment performs an untwisting process that untwists the side lines 21 in any section of the CFRP strands 2 (see first step to second step in FIG. 8).

Specifically, the length L in the untwisted section untwisted corresponding to the effecting tensile force is set, and the CFRP strands 2 are reversely stranded in a direction reverse of the stranded direction, and thus, the clearance where the curable materials 5 are filled is formed among the core wire 20 and the side lines 21. At this time, the core wire 20 has a role to form an axis of the untwisted diameter-expanded portion, therefore, an attention should be paid not to bend the core wire 20.

As illustrated in FIG. 8, an end portion of the general portion 4 outside the untwisted section not on an end portion side of the CFRP strands 2 may be bundled with the cable tie 6, such as INSULOK (registered trademark). This is for avoiding the strand of the general portion 4 from being undone any further and for smoothly performing an injection operation of the curable materials 5 in a later process.

(2) Bundling Process

Next, in the method for manufacturing the anchorage according to the embodiment, a bundling process to bundle both ends of the untwisted section untwisted in the previous process is performed (see third step in FIG. 8).

Specifically, the front and the rear of the untwisted section are bundled with the cable ties 6, such as INSULOKs (registered trademark). This is for ensuring the length L of the untwisted diameter-expanded portion 3 set corresponding to the effecting tensile force, and for improving the operation efficiency of the later operation. Surely, when the end portion of the general portion 4 has been bundled in the previous process, the process is only bundling the rest portion side of the CFRP strands 2 with the cable tie 6.

(3) Curable Material Filling Process

As a preparation of a filling process of the curable materials, a sheet form 7 is formed by wrapping the peripheral area of the untwisted section with a sheet, such as a blue tarpaulin and a plastic sheet so as not to cause the curable materials to leak out. This sheet form 7 has an opened upper portion such that the curable materials can be filled from above. Next, in the method for manufacturing the anchorage according to the embodiment, a curable material filling process that injects resin mortar, such as an epoxy resin, into the untwisted section is performed (see fourth step in FIG. 8).

As one example, as illustrated in FIG. 8, the resin mortar as the curable materials 5 are put in a filling instrument 50 in a syringe shape, and a filling port of the filling instrument 50 is inserted into the untwisted section to fill and cure the resin mortar.

It should be noted that, as described above, the material that should have firstly fluidity and cures after a predetermined time, such as grout cement mortar and polymer cement mortar, can be used as the curable materials 5. However, the strength of the curable materials is preferably equal to or more than the compressive strength (design criteria strength) of the concrete where the anchorage 1 is anchored.

When these curable materials 5 cure after elapse of a curing period, the states illustrated in FIG. 1 and FIG. 3 are provided, and thus, the fabricating operation of the anchorage 1 by the method for manufacturing the anchorage according to the embodiment is terminated.

Advantages of Anchorage of CFRP Strands and Method for Manufacturing

Next, the advantages of the above-described anchorage 1 will be described while comparing it with the past technique, such as a conventional anchorage of a CFRP strands and a conventional anchorage of steel PC strands.

(1) With the above-described anchorage 1 and method for manufacturing, the anchorage 1 is untwisted without needing a special machine or a device since the side lines 21 of the CFRP strands 2 are flexible, and the curable materials 5 can be filled in the clearance thus formed. In view of this, manufacturing (fabricating) of the anchorage 1 is extremely simple, thereby needing no plant production. However, the past anchorage needed the machine or device for manufacturing, and thus, the plant production was necessary.

In particular, in the case of the steel PC strands, stranding a hardened high strength piano wire provides a high strength and quality stable tendon. Therefore, untwisting the strands of the steel PC strands needed a dedicated tool or device due to high rigidity of the piano wire. In contrast to this, the CFRP strands 2 of the anchorage 1 are fabricated by integrating the continuous fibers, such as carbon fibers, aramid fibers, and glass fibers, as described above with a resin, thereby ensuring easily untwisting without the special tool.

(2) With the anchorage 1 and the method for manufacturing the same, no special skill is needed for manufacturing the anchorage 1. Everything can be processed and manufactured at the construction site. Thus, it only requires a labor for untwisting, a labor for filling, and a cost of the filler material, thereby being low cost in manufacturing. In contrast to this, the conventional anchorage of the CFRP strands needed the metal sleeve having rigidity for anchoring by the expansion pressure of the expansion material and the friction force between the expansion material and the metal sleeve, and therefore, it was necessary to work in a plant or the like until securing the metal sleeve to the CFRP strands. In view of this, it was expensive and transport efficiency was also poor.

(3) With the anchorage 1 and the method for manufacturing the same, the anchorage 1 can be manufactured with any anchoring processing position, and therefore, the anchoring position can be conveniently set. Therefore, a flexible application, such as after anchoring once, additionally placing concrete for joint and anchoring, is possible. That is, the anchoring position is not limited to the end portion of the CFRP strands, thus improving a freedom of design.

The anchoring structure corresponding to a U-shape hook and an L-shape hook used in the rebars anchoring structure in the past technique can be achieved with the anchorage 1, thereby ensuring establishing the anchoring structure even after the reinforcement works have been done in some cases.

(4) With the anchorage 1 and the method for manufacturing the same, all anchoring of the anchorage 1 is anchoring inside the concrete member, thereby no risk of deterioration of the anchoring end portion. In particular, when the CFRP strands were applied as a tendon, external anchoring had a risk due to an accident and the like even though a rustproof material was applied for the anchoring end portion. However, with the anchorage 1, not only it does not rust, but a possibility of ultraviolet degradation is also reduced since the CFRP strands are hidden inside the concrete.

(5) With the anchorage 1 and the method for manufacturing the same, since the length L of the untwisted diameter-expanded portion 3 is five times or more the diameter D1 of the general portion 4, it is compact compared with the past anchorage. Therefore, it can be utilized for joint between the concrete members, thereby ensuring downsizing the joint portion.

(6) With the anchorage 1 and the method for manufacturing the same, the metal sleeve or the like is not used. Therefore, there is no risk of metallic corrosion, and it is possible to establish the whole concrete structures with non-corrosive materials. In contrast to this, the conventional anchorage of the CFRP strands, as described above, needed the metal sleeve for anchoring by the expansion pressure of the expansion material, and the metal sleeve needed to be made of highly durable stainless steel for rust prevention, and therefore, there was a problem of a high manufacturing cost.

(7) With the anchorage 1 and the method for manufacturing the same, the curable materials 5 used as a filler are a structure that receives the compressive stress, thereby no risk of receiving a long-term structural deterioration. Even when the CFRP material receives a fatigue load, there also lies no risk of fatigue destruction of the curable materials 5.

(8) With the anchorage 1 and the method for manufacturing the same, the curable materials 5 of the untwisted diameter-expanded portion 3 are cured before placing the concrete of the concrete structure where the anchorage 1 is anchored. In view of this, there occurs no problem of failing in providing desired bearing pressure and bonding force caused by a failure of successfully filling the placed concrete inside the untwisted diameter-expanded portion 3 when it is attempted to anchorage in the concrete in which the coarse aggregate is mixed in the clearance among the unraveled element wires like the conventional anchorage that does not preliminarily fill the curable materials 5 in the untwisted diameter-expanded portion 3, thereby sufficiently functioning as an anchorage.

(9) With the anchorage 1, end portion anchoring when tensioning the CFRP strands can be not only utilized in a usage that preliminarily anchors in the concrete fixing end, but also utilized in a usage that anchors in, what is called an anchoring method after prestressing, which anchors by placing concrete, cement grout, or cement mortar in the peripheral area after prestressing in a state where the anchorage 1 is in the middle of the CFRP strands. In particular, the utilizing method as the stressed end is dramatically simple and downsizing of the anchorage is significant compared with the anchoring method up to the present.

(10) With the anchorage 1 and the method for manufacturing the same, it is not necessary to have a member corresponding to the metal sleeve, and to fit the CFRP strands in a mold and perform a heating process to bend the CFRP strands in a plant or the like as with a conventional anchorage. The anchorage 1 is manufacturable even at a construction site, thereby ensuring a reduced manufacturing cost. Moreover, since the member corresponding to the metal sleeve is not necessary, the CFRP strands can be transported in a rolled shape, thereby increasing the transport efficiency, thus ensuring a lowered transportation cost.

Second Configuration

Figure 9:
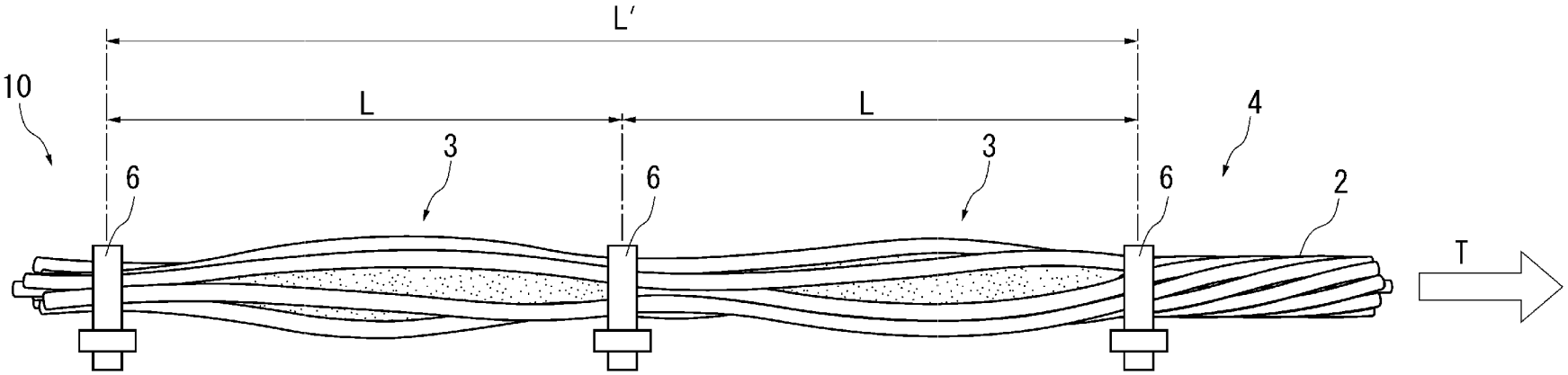
FIG. 9 is a side view, viewed in a direction perpendicular to an axial direction of CFRP strands, illustrating a second configuration of an anchorage of CFRP strands.

Next, using FIG. 9, an anchorage 10 of a CFRP strands according to a second embodiment of the present invention will be described. The anchorage 10 according to the second configuration is different from the above-described anchorage 1 according to the first configuration only in that there are formed two untwisted diameter-expanded portions 3, and therefore, a description is mainly made on that point, and a detailed description will not be further elaborated by attaching identical reference numerals to identical configurations. FIG. 9 is a side view, viewed in a direction perpendicular to an axial direction of the CFRP strands, illustrating a configuration of the anchorage 10 according to the second configuration.

As illustrated in FIG. 9, the anchorage 10 according to the second configuration is an untwisted type anchorage mainly configured of the above-described CFRP strands 2, two untwisted diameter-expanded portions 3 formed continuously to an end portion of the CFRP strands 2, and the like. Between the two untwisted diameter-expanded portions 3 is narrowed down by being bundled with the above-described cable tie 6.

With this anchorage 10, forming a plurality of the untwisted diameter-expanded portions 3 in some cases is more advantageous than the anchorage 1 having the above-described single untwisted diameter-expanded portion 3 depending on conditions of anchoring performance and anchoring space applied as an anchorage of CFRP strands.

With the anchorage 10, relatively shortening the untwisted section and utilizing a bearing effect in a front portion of the anchorage 1 described in the anchoring mechanism 1 ensure increased contribution portion that improves the anchoring efficiency as its reactive force. In view of this, it is possible to shorten a total length L' (L+L) of the two untwisted diameter-expanded portions 3 as an anchoring length of the anchorage 10. Surely, it is needless to mention that selections of the length L and the number of the untwisted diameter-expanded portion 3 can be appropriately determined considering the compressive strength of the concrete to be anchored, the proximity degree of other anchors 1 and 10, and the like.

Third Configuration

Figure 10:
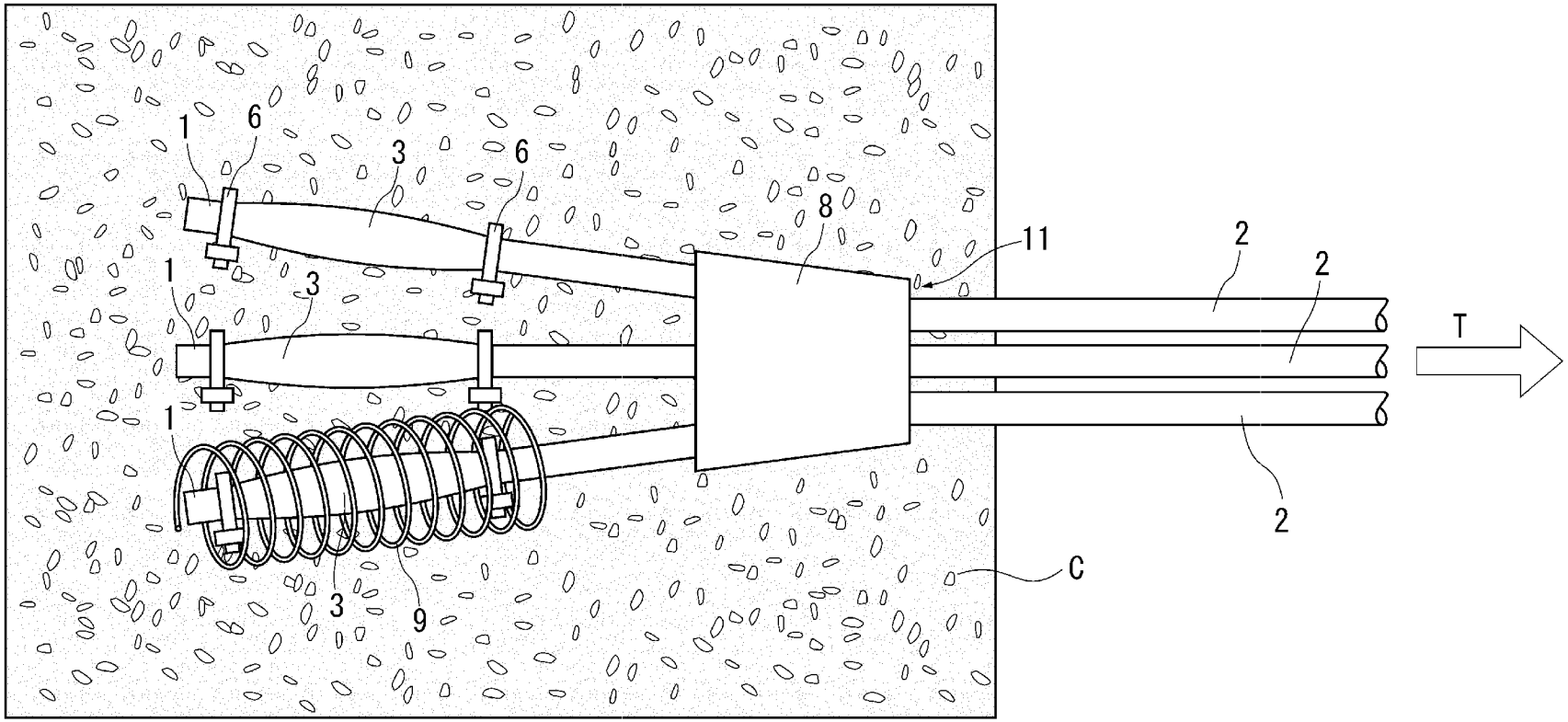
FIG. 10 is a side view, viewed in a direction perpendicular to an axial direction of stranded wires, illustrating a third configuration of an anchorage of CFRP strands.

Next, using FIG. 10, as an anchorage 11 of CFRP strands according to a third configuration of the present invention, a description will be given of an application example when the above-described anchorage 1 is used as an anchorage of a fixing end of the tendons that apply the prestress to a PC structure. The anchorage 11 according to the third configuration is different from the anchorage 1 according to the above-described first configuration in that it is a multistrand (multiple strand) system anchorage in which a plurality of the CFRP strands 2 (the anchorage 1) are brought together with a deviator 8. Accordingly, a description is mainly made on that point, and a detailed description will not be further elaborated by attaching identical reference numerals to identical configurations. FIG. 10 is a side view, viewed in a direction perpendicular to an axial direction of stranded wires, illustrating a configuration of the anchorage 11 according to the third configuration.

When a tendon to which high tensile force effects, like a fixing end of a tendon that applies a prestress to a PC structure, is anchored in a concrete structure, a space for dispersing the anchoring force is necessary in its peripheral area. In view of this, the anchorage according to the third configuration uses a plurality of the anchors 1 according to the above-described first configuration and it disperses the anchors 1 in a circumferential direction from a core axis with the deviator 8.

The reference numeral 9 is a spiral reinforcement mounted freely fitted to each of the untwisted diameter-expanded portions 3 of the respective anchors 1, although only one is illustrated in the drawing. This spiral reinforcement 9 has a function to resist split tensile fracture caused by ring tension (annular tensile force) when the untwisted diameter-expanded portion 3 pushes and opens the concrete to cave into the concrete. With the spiral reinforcement 9, excessive rebars reinforcement is avoided to reduce a difficulty of casting concrete, and an excellent toughness can be provided. However, this spiral reinforcement 9 is not a necessary configuration requirement of the present invention.

The anchorage 11 according to the third configuration ensures a significantly economical end portion anchoring structure compared with the conventional multistrand system anchorage formed of steel PC strands. It is extremely advantageous in the interests in rust prevention compared even with a conventional anchoring end portion of a CFRP material since no metal member is present. Moreover, the anchorage does not require being filled with the mortar and the like later as in a conventional manner, has reduced possibilities of ultraviolet resistance and aged deterioration, and can solve a problem of an increased manufacturing cost by producing with a stainless steel.

Fourth Configuration

Figure 11:
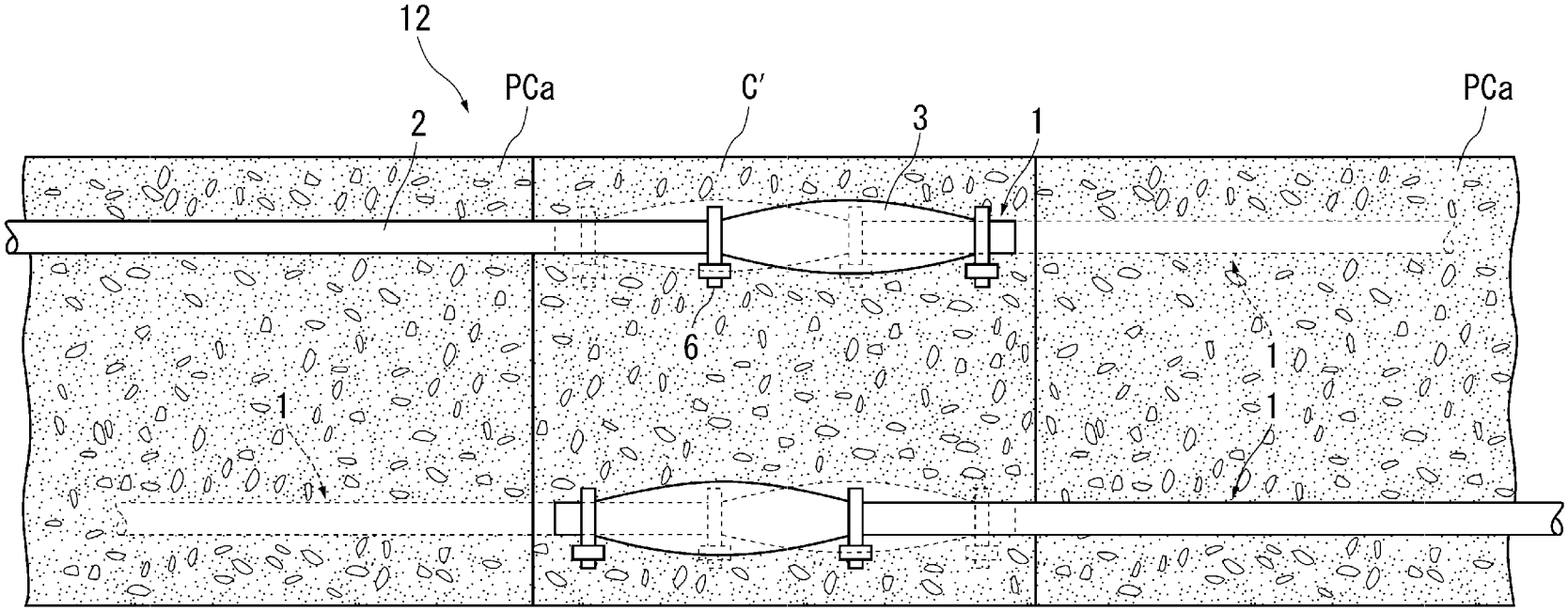
FIG. 11 is a vertical cross-sectional view illustrating a case where the first configuration anchorage of the CFRP strands is applied to a filling concrete joint portion between pre-cast floor slabs.

Next, using FIG. 11, a description will be given of an application example when the above-described anchorage 1 is applied to a connection between precast concrete slabs as an anchorage 12 of CFRP strands according to a fourth configuration of the present invention. FIG. 11 is a vertical cross-sectional view illustrating a case where the anchorage 1 according to the first configuration of the present invention is applied to a filling concrete portion between the precast concrete slabs.

As illustrated in FIG. 11, the anchorage 12 according to the fourth configuration uses the CFRP strands 2 instead of the conventional rebars of the precast concrete slab. The above-described anchors 1 are applied by being overlapped in a staggered manner such that the above-described untwisted diameter-expanded portions 3 are arranged in a filling concrete C' portion as a connecting portion between the precast concrete slabs.

With the anchorage 12 according to the fourth configuration, since the anchorage 1 is compact as described above, a joining length of a joining portion of the precast concrete slabs is shortened. In view of this, a placement amount of the filling concrete C' decreases to ensure achieving a reduced joining operation time and improved work efficiency in site.

It should be noted that, as the anchorage 12 according to the fourth configuration, the case of applying it to the connection between the precast concrete slabs has been described as an example. However, the anchorage according to the present invention can be applied to a U-shape hook joint and the like used for lap joint of rebars or joining the major precast reinforced concrete structures such as the concrete column structures or the concrete girder structures.

The anchorage of the CFRP strands according to the embodiment of the present invention and the method for manufacturing the same has been described in details above. However, any of the above-described or illustrated embodiments is merely one embodiment embodied for executing the present invention, and therefore, the technical scope of the present invention should not be interpreted in a limited way because of these.

Particularly while the description has been made by illustrating concrete structures, it is considered that the present invention is applicable to an anchorage (anchoring structure) of a tendon of another type of structures, such as a masonry structure. Basically, the present invention is preferably applicable to an anchoring structure relating to a joint between structures.

DESCRIPTION OF REFERENCE SIGNS

1, 10, 11, 12: Anchorage (anchorage of CFRP strands)
2, 2', 2": CFRP strands
20: Core wire (element wire)
21: Side line (element wire)
3: Untwisted diameter-expanded portion (CFRP strands)
D2: Maximum diameter of untwisted diameter-expanded portion
4: General portion (CFRP strands)
D1: Diameter of general portion
5: Curable material
50: Filling instrument
6: Cable tie
7: Sheet frame
8: Deviator
9: Spiral reinforcement
C: Concrete
C': Filling concrete
L: Length of untwisted diameter-expanded portion (length of untwisted section)
L': Total length of untwisted diameter-expanded portion
PCa: Precast concrete slab (precast member)
A: Bonding force
B: Bearing resistance
T: Tensile force

The invention claimed is:

1. An anchorage of continuous fiber-reinforced polymer strands, comprising:

a continuous fiber-reinforced polymer strand formed by stranding a plurality of element wires that are bound together multiple continuous fibers in a first direction; and a single or a plurality of untwisted diameter-expanded portions radially expanded with respect to a diameter of a general portion of the continuous fiber-reinforced polymer strand, the single or plurality of untwisted diameter-expanded portions being reversely stranded in a direction reverse to said first direction, the single or plurality of untwisted diameter-expanded portions being radially expanded by filling and curing curable materials in a clearance among the plurality of element wires, the general portion being other than the single or plurality of untwisted diameter-expanded portions of the continuous fiber-reinforced polymer strand, the single or plurality of untwisted diameter-expanded portions receiving bearing resistance by directly contacting at least one surrounding curable materials, selected from the group consisting of concrete, cement grout, and cement mortar.

2. The anchorage of the continuous fiber-diameter-expanded reinforced polymer strands according to claim 1, wherein said single or plurality of untwisted portions terminates at ends and wherein each of the ends has a cable tie so as not to be further untwisted.

3. The anchorage of the continuous fiber-reinforced polymer strands according to claim 1, wherein the single or plurality of untwisted diameter-expanded portions has a length that is at least five to twenty times the diameter of the general portion.

4. The anchorage of the continuous fiber- reinforced polymer strands according to claim 1, wherein the single or plurality of untwisted diameter-expanded portions has a maximum diameter that is at least 1.2 to 2.6 times the diameter of the general portion.

* * * * *